United States Patent [19]

Henrich

[11] Patent Number: 4,553,707

[45] Date of Patent: Nov. 19, 1985

[54] PROCESS FOR WINDING WIRE UPON A REEL

[76] Inventor: Werner Henrich, Am Wachtgipfel, D-6349 Hörbach, Fed. Rep. of Germany

[21] Appl. No.: 211,907

[22] Filed: Dec. 1, 1980

[30] Foreign Application Priority Data

Nov. 30, 1979 [DE] Fed. Rep. of Germany ..... 2948241

[51] Int. Cl.[4] ..... B65H 54/04; B65H 54/28; B65H 55/04; B65H 49/02

[52] U.S. Cl. ..... 242/25 R; 242/47; 242/128; 242/159; 242/170; 242/171; 242/172; 206/391; 206/409; 206/410

[58] Field of Search ..... 242/25 R, 18 R, 47, 242/128, 129, 159, 163, 170, 171, 174, 175, 176, 177, 178, 158 R, 158.2, 158.4 R; 206/391, 409, 410

[56] References Cited

U.S. PATENT DOCUMENTS

| | | | |
|---|---|---|---|
| 1,936,227 | 11/1933 | Cook | 242/170 X |
| 2,101,282 | 12/1937 | Piper | 242/159 X |
| 2,186,981 | 1/1940 | MacKinnon | 242/170 X |
| 2,326,928 | 8/1943 | Courson | 242/159 X |
| 2,596,970 | 5/1952 | Adams | 242/170 |
| 2,709,553 | 5/1955 | Wellcome | 242/171 |
| 3,000,493 | 9/1961 | Hirst | 242/170 |
| 3,001,642 | 9/1961 | Hirst | 242/170 X |
| 3,645,469 | 2/1972 | Fischer et al. | 242/159 X |
| 3,700,185 | 10/1972 | Hubbard et al. | 242/159 |
| 3,976,269 | 8/1976 | Newberry et al. | 242/25 R |
| 4,235,070 | 11/1980 | Bravin | 242/25 R X |
| 4,398,677 | 8/1983 | Henrich | 242/25 R |

*Primary Examiner*—Stanley N. Gilreath
*Attorney, Agent, or Firm*—Edmund M. Jaskiewicz

[57] ABSTRACT

Wire is wound in conical layers upon a conical core of a reel or other structure upon which wire can be wound until a predetermined outer diameter of a wound reel is reached. The wire is then wound in layers of decreasing lengths to form a wound reel which has an outer cylindrical shape of the same diameter. A reel can be used from which the core can be removed after winding so that upon unwinding, the wire can be pulled from the interior of the wound reel.

18 Claims, 9 Drawing Figures

PROCESS FOR WINDING WIRE UPON A REEL

The present invention relates to winding of wire upon a reel or other form of a wire carrier, more particularly, to a process for the winding of wire in conical layers upon a reel.

Wire is generally wound onto reels or drums having a cylindrical core and the wound wire is in the form of cylindrical layers of wires. Reels have also been used having a slightly conical core but the wire is wound onto these reels similarly in cylindrical layers. Such reels or drums having these conical cores are primarily used for the winding of varnished or other coated wires and in a subsequent winding operation these wires are then unwound at a relatively high speed from the outside to the inside of the reel of wire. The conical shape of the cores prevents falling of the layers of wire from off the core and provided the possibility of using a smaller diameter of reel at the unwinding side of the reel which eases the unwinding carried out by a winding head.

In the winding of relatively thick wires, i.e. having a diameter of approximately 8 mm or greater, it has been known to completely remove the reel after completion of the winding process. The drum has been constructed so as to be collapsible or separable and the wire can then be unwound from the wound reel proceeding from the inside to the outside of the reel.

The disadvantage of winding wire in cylindrical layers is that the turns of wire in a single layer each have the same diameter. Since the turns of wire tend to loosen when the wire is being unwound from the reel, there is the constant possibility that the loosened turns of wire slide downwardly and become entangled with each other which in turn leads to breakage of the wires. Such entangling of the wires occurs particularly when the drums are positioned vertically or substantially vertically during the unwinding operation.

A further disadvantage in the unwinding of cylindrically wound wires is that when the reel is almost completely unwound and only a few layers of wire remain, these remaining wires may collapse and tangle with respect to each other since it becomes impossible for these identically dimensioned turns of wire to support themselves. When the wires become entangled in this manner they are no longer of use and may have to be discarded. It is apparent that if several layers of wire on each reel of wire must be discarded as result of tangling during the unwinding operation that the economics of the process are affected and the cost of the wire becomes significantly greater.

In addition to the previously discussed disadvantage there is a problem when wire is being unwound from inside to the outside of the reel since because of the presence of winding tension wires which are to be unwound in a relatively straight line are wedged in by the next wire layer. This also leads to breakage of the wires particularly when the wires are very thin in diameter.

It is therefore the principal object of the present invention to provide a process for the unwinding of wire so that the wire may be completely unwound from a reel without any risk of entangling the wire.

It is another object of the present invention to provide a process for the winding of wire which can be simply and effectively carried out without the utilization of special or complicated equipment or apparatus.

According to one aspect of the present invention a process for winding wire upon a reel and the like may comprise the steps of winding the wire in conical layers upon a conical core of a reel until a predetermined outer diameter of a wound reel is reached. Subsequently, the wire is then wound in layers of decreasing lengths to form a wound reel having an outer cylindrical diameter equal to the predetermined outer diameter. The wound reel can then be unwound from the inside to the outside of the reel either by removing completely the core or by moving the core axially so as to provide a space between the inner layer of wire and the core, the wire being pulled through this space.

The conical arrangement of each of the layers of wire prevents the wire and even loose wire which is being unwound from sliding downwardly since each layer is supported by the next succeeding wire layer. Further, any jamming or tangling of the wire is also avoided. This is particularly true when the wire is unwound from the bottom to the top since the turn being unwound has a smaller diameter than the turn immediately above it.

Other objects and advantages of the present invention will be apparent upon reference to the accompanying description when taken in conjunction with the following drawings, which are exemplary, wherein.

Proceeding next to the drawings wherein like reference symbols indicate the same parts throughout the various views a specific embodiment and modifications of the present invention will be disclosed in detail.

Figure 1:
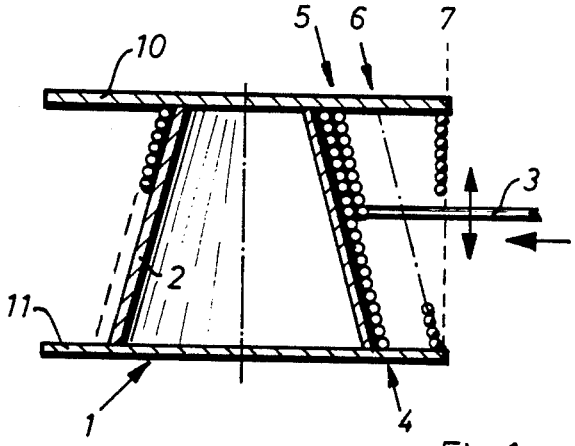
FIG. 1 is a vertical sectional view of a reel showing the positioning of the wire turns and layers during a winding operation.

In FIG. 1 there is illustrated a reel or drum 1 having a conical core 2 upon which a wire or cable is to be wound in layers. The innermost layer of wound wire is indicated at 4 and is positioned between flanges 10 and 11 of the reel and the flanges are attached to the ends of the core in a known manner. The innermost winding layer 4 will thus have a conical shape conforming to the conical shape of the core 2. The next winding layer 5 is positioned on the innermost layer 4 and, similarly, has a corresponding conical shape. The wire 3 is thus normally wound uniformly around the core until a turn of the wire reaches one of the flanges 10 and 11 at which point the movement of the wire is reversed so that the wire is wound in turns proceeding to the opposite reel and the next succeeding layer.

Figure 2:
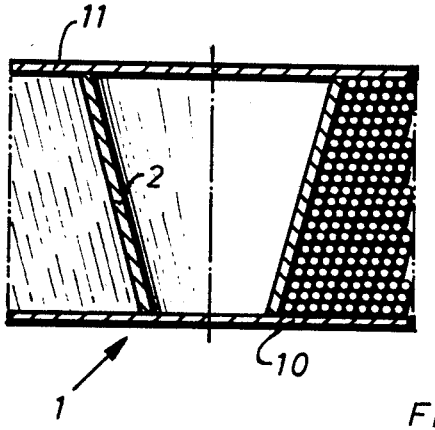
FIG. 2 is a vertical sectional view of a reel which is completely wound with wire but showing the reel in an inverted position with respect to that of FIG. 1.

The wire is wound in this manner until an outer layer of wire reaches the outer diameter of the flange 11. Up to this point all of the conical layers of wire have the same length as measured in the axial direction of the reel. However, when the outer diameter of the flange 11 is attained the wire is wound in layers of decreasing lengths as can be seen in FIG. 2 so as to form a cylindrical coil of wire on the conical core as also shown in FIG. 2. The outer cylindrical form of the wound reel or package is indicated by the line 7 wherein the wound or package reel has a uniform diameter therethrough equal to the predetermined diameter of the reel when shorter layer lengths began to be wound.

It will be apparent from FIG. 2 that the radius of the successive turns of wire in a winding layer vary. In view of the constantly varying radius of the wire windings and the constant rotary speed of either the reel or a flyer, it is apparent that there will be considerable variation in the speed at which the wire is wound. In order to compensate for these variations in speed, it is known in the art to provide a measuring and storing device which either regulates the speed of the wire or temporarily stores the wire in a known storage reservoir from which the wire is supplied to the reel at the necessary speed.

By such a use of a wire storage reservoir the reel or the flyer rotates at a rotary speed which corresponds to the wire speed in winding a layer of wire in the middle between the end flanges of the reel. During further winding of a wire layer in the direction of the smaller diameter of the core less wire will be wound upon the reel while the wire is being supplied from the drawing machine or other interposed apparatus at a constant running speed. During this phase of winding of the wire layer that wire which is not delivered to the spool is then accumulated in the variable storage reservoir. When the middle point between the two end flanges of the reel is crossed over by the wire during the winding of the next wire layer proceeding toward the larger diameter portion of the reel core, the reel will then require more wire than what is being supplied from the wire machines. This greater requirement of wire will now be supplied by a quantity of wire previously accumulated in the storage reservoir when the smaller diameter end of the core was being wound. This process proceeds for the winding of each wire layer. The necessary decrease in rotary speed because of the varying winding diameters of each wound wire layer can also be obtained in conventional ways known in the art through suitable regulating and control apparatus.

According to the present invention it is advantageous to utilize both of the above-named measures when particularly heavy or severe speed changes occur because of the conical winding, which means that a regulating apparatus for the reel or the flyer will bring about rotary speed reduction necessitated by a constant diameter winding as well as the partial compensation by winding layers of wire on conical winding surfaces. In order to keep within limits the rotary speed differences between the largest and smallest winding diameters of a layer of wire, the compensating operation of the previously described so-called breathing or pulsating storage reservoir can be superimposed upon the operation of the speed regulating device.

Figure 3:
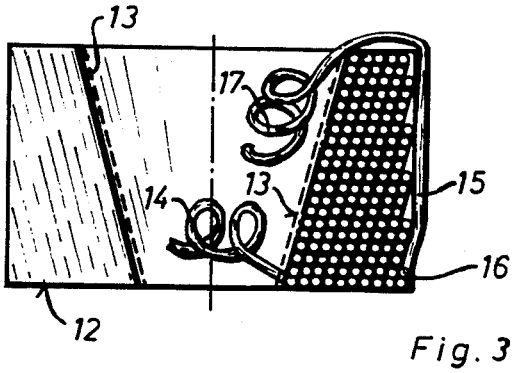
FIG. 3 is a view similar to that of FIG. 2 but showing the wound wire without the reel.

FIG. 3 shows a wound coil of wire from which the reel and its core have been removed. The coil of wire is packaged by shrink-fitting a plastic sheet or foil 12 to enclose the entire coil with the sheet either passing over the inner opening from which the core has been removed or being inserted into the opening so as to be shrunk around the walls of the opening. In the latter case it is preferred to insert a cardboard packaging core 13 against the inner layer of the coil. The inner casing 13 provides a secure support for the innermost winding layer particularly during transportation and shipping. The casing 13 can also be used as a guide for the wire during unwinding from the interior of the coil. Such an inner casing can also be inserted after the entire winding coil has been enclosed in a shrunk-fit sheet or foil.

The end of the wire 15 which follows from the last turns 16 on the wound reel can be inserted into the interior of the wound reel so as to exist as a excess of wire indicated at 17. This excess wire 17 can also be positioned within the coil of wire in the form of additional windings or turns. The end of the wire 17 can also function as the beginning of a new reel of wire if there is to be a continuous winding of the wire succeeding from this one coil.

Figure 4:
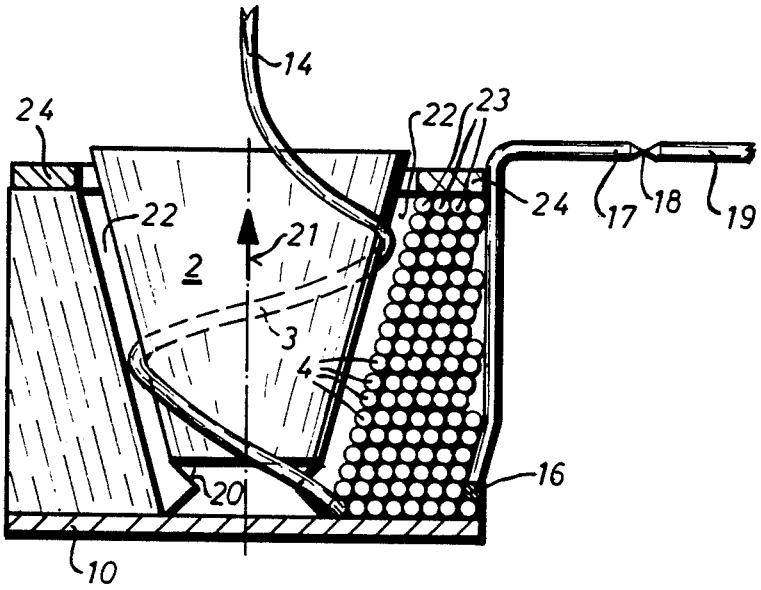
FIG. 4 is a vertical sectional view of a wound coil of wire during the unwinding operation.

In FIG. 4 there is shown the wire being unwound for a further treatment or processing operation. The end portion 17 of the wire has been fused or welded at 18 with the beginning or leading end 19 of a further coil of wire. The beginning or leading end 14 of the coil can now be withdrawn from the interior of the coil. For the purpose of unwinding the coil either the upper flange 11 by itself can be removed from the reel or the upper flange 11 together with the core 2 can be removed. With the removal of the flange 11 and/or core 2 the wire can then be discharged or withdrawn beginning from the lower flange 10 as viewed in FIGS. 2 and 3. If the wire coil has been packaged in shrunk-fit material, this packaging material can be simply and readily removed.

As may be seen in FIG. 4 the end of the core 2 is connected to the lower reel flange 10 by means of a bellows or other type of expansible connection indicated at 20 so that the core 2 can be displaced axially in the direction of the arrow 21.

The displacement and subsequent anchoring in position of the core in order to provide an annular slot or space through which wire can be unwound in the manner as illustrated can be carried out in any suitable manner as known in the art. As result of the displacement of the core there will be formed between the core 2 and the innermost layer of wire 4 a space or annular slot 22 through which the wire 3 can be withdrawn.

During winding of the wire, the core 2 is inserted completely within the wound package so as to rest against the inner windings 4 in the manner as shown in FIG. 2. During unwinding, as illustrated in FIG. 4, the core 2 is moved outwardly in the direction of the arrow 21 by means of the bellows 20 which is pneumatically or hydraulically powered. The powered bellows can thus be stopped in any position and will thus position the core 2 axially as shown in FIG. 4 such that a space 22 is formed between the outer surface of the core and the inner windings 4. The wire 14 is then unwound through the space 22. As the winding progresses, the space 22 will become wider and this increased space minimizes the possibility of tangling or kinking of the wire during unwinding.

The conical core sleeve 13 can also be employed at the point of a further processing operation and for this purpose, at the beginning of an unwinding process, can be positioned in the same way to form the slot or space 22 as illustrated in FIG. 4. The core sleeve positioned or inserted in such a manner within the coil functions as a guide line or edge for the wire and prevents complete turns of wire being withdrawn from the coil which might cause entangling, kinking or looping of the wire which in turn could lead to breaks in the wire.

As the wire is unwound or drawn off by layers, the slot or space 22 will become larger after the unwinding of each layer and the quantity of wire remaining on the coil becomes correspondingly smaller. When the outer cylindrical wall of the wire coil is reached during the unwinding process, the wire coil thus also becomes smaller in height from layer to layer.

Figure 5:
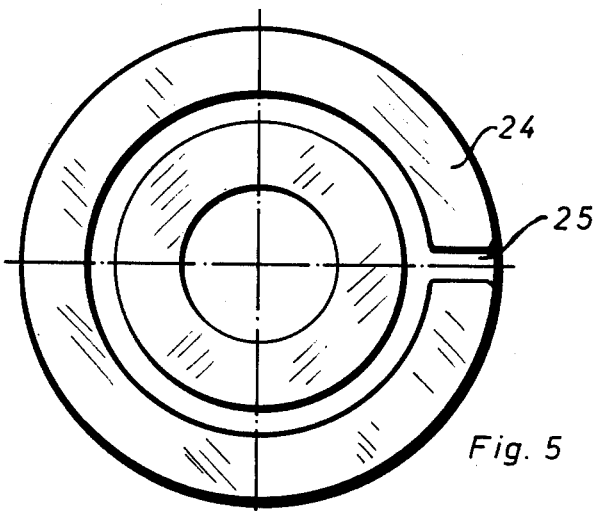
FIG. 5 is a top plan view of the wire coil in FIG. 4.

In order that the upper windings 23 are not carried along during the unwinding, a heavy plate 24 of metal or some other suitable material is positioned on these upper windings as shown in FIG. 4. This plate may be of sufficient weight so that it will stay in position and perform its function of its own weight or a lighter weight plate can be used which can be connected or detachably locked to the lower flange 10. As seen in FIG. 5, the plate 24 is annular in shape and is provided with a radial slot 25.

Figure 6:
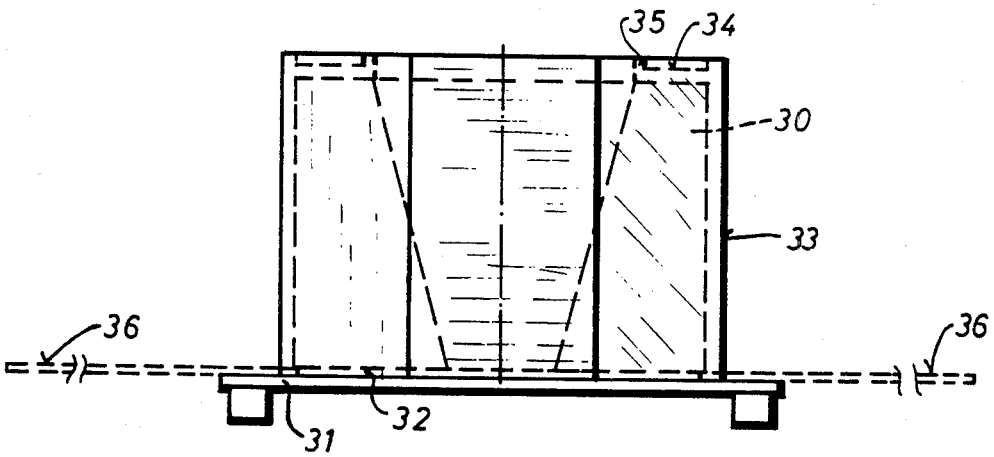
FIG. 6 is a side elevational view of a wound coil of wire packed in a container.
Figure 7:
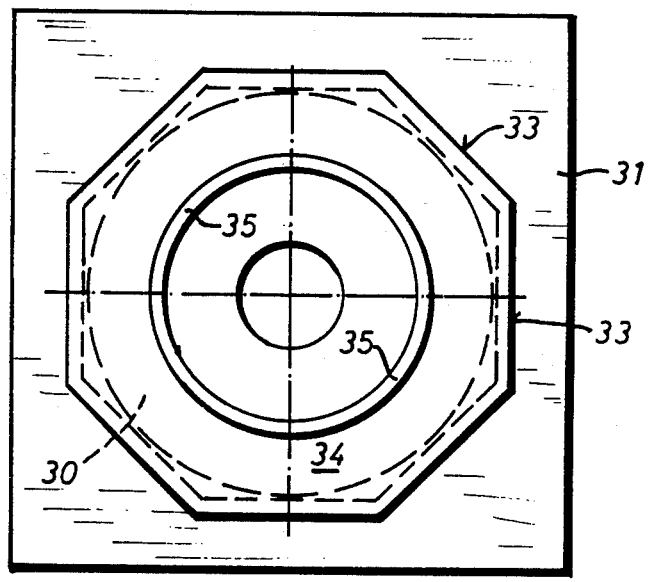
FIG. 7 is a top plan view of the container of FIG. 6.

In FIGS. 6 and 7 there is shown a modification of the present invention wherein a wound coil of wire 30 is mounted on a pallet of the type which is generally used for the carrying of many different articles and which can be readily lifted by a lift truck or the like. The lower flange 32 is fastened in a suitable manner to the pallet such as by a suitable adhesive, bolted or attached by screws to the pallet. As a further modification the pallet itself can function as a flange for the coil of wire. Also attached to the pallet 31 is a six-sided casing or container wall 33 which encloses the reel of wire to function as a packaging for the wire coil. The outer wall of the packing container can also be constructed in parts or sections which can be folded down into the horizontal positions as indicated at 36 in FIG. 6 into substantially the plane of the pallet during the winding of the wire onto the wire coil. In order to avoid or reduce any projecting of the package or container over the edge of the pallet the outer wall of the container can advantageously be constructed so as to be foldable or collapsible. The container wall or packaging enclosure together with its top wall or portion 34 can be positioned over the wound coil of wire from above after winding has been completed and, subsequently, the lower or bottom portion of the container wall can then be attached to the pallet.

When the wound coil of wire is enclosed on its upper face with an annular wall portion 34 it is preferable that the inner surface of the wall portion 34 be provided with an inner rim or edge 35 made of a hard wear-resistant material so as to provide a surface over which the wire can be pulled during unwinding of the coil. The annular wall portion 34 can also be constructed of a single piece of suitable material. When constructed in this manner, the annular top wall 34 and its inner edge 35 can replace the plate 24 as described in FIG. 4.

In place of the edge of hard material a ring of wear-resistant material can be positioned over the edge of the top wall portion 34 before beginning a further operation of the wire requiring unwinding of the wire from the coil.

Figure 8:
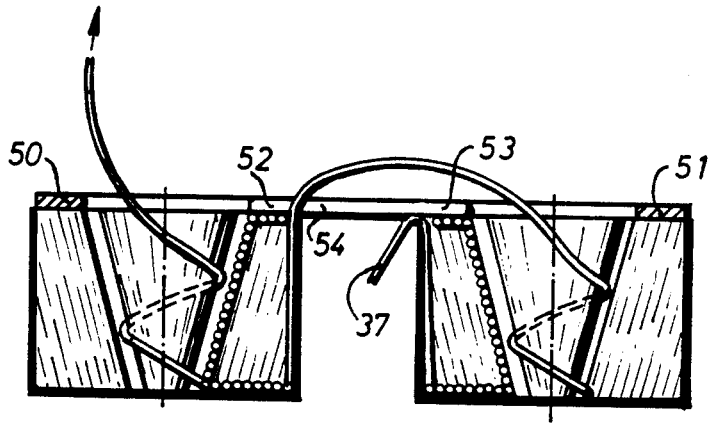
FIG. 8 is a vertical sectional view of two wound coils of wire in a continuous unwinding operation.
Figure 9:
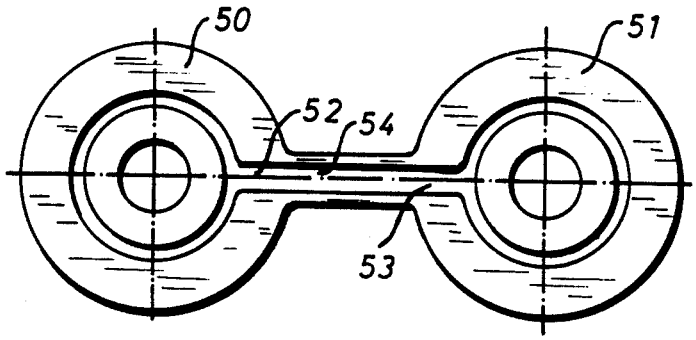
FIG. 9 is a top plan view of the coils of FIG. 8.

It is extremely advantageous not to interrupt the operation for a further treatment or processing by the necessity of replacing a completely unwound coil of wire with a new coil of wire. It is therefore advantageous and more economic if one can provide a continuous unwinding operation. In order to achieve a continuous unwinding process two coils of wire are positioned at the site of the unwinding operation as shown in FIG. 8. Both coils of wire are each provided with annular cover rings 50 and 51 having opposed radial slots 52 and 53 through wire can be drawn. During a normal unwinding process from the interior of the wound package it is preferable that these slots be closed such as by arcuately movable plates or the like so as to provide a completely enclosed smooth inner ring since otherwise there is a danger that the wire might become damaged at the locations of the slots. Each annular cover plate 50 and 51 is covered by a correspondingly shaped annular cover plate each of which also has a radial slot but during the unwinding, the radial slots are in positions offset from the slots 52 and 53 of the rings 50 and 51. The slots of the second plates remain in these offset positions during the unwinding. When the left reel is being unwound as seen in FIGS. 8 and 9, when the end of this coil of wire is reached, the plate covering annular plate 50 is rotated so that its slot corresponds with slot 52 and at the same time the second plate covering annular covering 51 is rotated so its slot corresponds with slot 53. The last turn of wire from the left reel is then guided through the slot 52, guide slot 54 and slot 53 to be connected to the beginning of the wire on the right reel. At that moment that there is a transfer of the wire from the used or completely unwound coil to a new coil of wire both slots will be opened and after the transfer immediately closed.

FIG. 8 illustrates that portion of the process when the left reel of the wire is being unwound. The end of this coil of wire is guided upwardly and out of the outer cover of the container and is connected with the beginning of the coil of wire on the right through welding or some other suitable fusing or connecting process. As soon as the last turn of wire is pulled from the left coil of wire, the wire is then guided through the open slot in the left cover ring and through the guide slot 54 provided between both cover rings through on into the interior of the right coil of wire and the wire will then be further unwound from within the interior of the coil of wire on the right. During the unwinding process from the coil of wire on the right a new coil of wire will be positioned on the left since the previous coil of wire on the left had been completely unwound. The beginning end of the new coil of wire will then be connected in a known manner with the wire end 37 protruding from the coil of wire on the right. When the coil of wire on the right is completely unwound, the unwinding procedure will then be transferred to the left hand coil in the same manner as described above.

In a modification of the continuous winding operation as described above, when the last turn of wire is unwound from a coil of wire the entire cover ring is then transferred to the new or full coil of wire and positioned on the new coil as a cover member. In this modification the cover ring does not have a slot. However, the connection between the beginning and ends of the wires is carried out in the same manner as illustrated in FIG. 8 and as described above.

It is apparent that in order to unwind the wire, the wound reel is placed in such a position that the larger diameter end of the core points upwardly. Subsequently, the drum flange and the core can be removed or the core displaced axially so as to form a space between the core and the innermost wire layer and the wire is subsequently pulled from this opening.

When a wound reel is in the position of FIG. 2 in preparation for being unwound it is apparent that the conical arrangement of each of the wire layers prevents wire or even loose wire which is being unwound from sliding downwardly since the turns and layers are supported by the next succeeding wire layer.

In order to unwind the wire from a reel, the axis of the reel need not be positioned vertically when relatively thick wires have been wound upon the reel and are now to be unwound. With heavier wires, because of residual stress, the windings will remain in their positions even when the reel is disposed horizontally. The angle of taper of the wound layers of wire or the angle of taper of the reel core can be selected depending on the various conditions including the thickness of the wire and the diameter of each wound turn.

According to the process it is preferable that the reel upon which wire is to be wound is provided with a conical core. However, a conventional collapsible reel having a cylindrical core may be used together with a conical insert or enclosure which can be suitably attached to the flanges of the drum or mounted over the cylindrical core of the reel. In a collapsable reel having a cylindrical core, the ends of the core are attached to the end flanges by means of bolts. By unfastening the bolts on one flange this flange can be removed and a conical core or insert can then be positioned over the cylindrical core. The flange is then replaced and the flange is attached by bolts both to the ends of the cylindrical core and to the conical insert.

If the wire is to be wound upon a reel by means of a flyer rotating around a stationary reel, it is then necessary that the core only need to withstand the winding pressure. Under these circumstances the core and flange of the reel may be made of cardboard, heavy paper or relatively thin material. However, if the wire is to be wound by rotating the reel, it is then preferable that reels of conventional materials be employed.

Once the wire has been completely wound upon a reel, the wound wire in the form of a coil can be transported either with or without its reel. In either event, it is preferable to protect the wire against corrosion and the like by means of packaging materials made of paper, synthetic resin materials, cardboard and the like. If a wire coil is shipped without its respective reel, it is preferable to protect against any shifting of displacement of the wire layers either by tying bands of synthetic resin materials, steel or the like around the wire coil or by shrink-packaging the coil with a synthetic plastic foil. It is also possible to reinforce or strengthen a wire coil by positioning a conical core casing or shell, which may be made of cardboard, within the coil. It is also possible to so package a wire coil for shipment that a portion of the packaging constitutes at least a portion of the reel, at least partially for winding and unwinding operations.

It will be understood that this invention is susceptible to modification in order to adapt it to different usages and conditions and, accordingly, it is desired to comprehend such modifications within this invention as may fall within the scope of the appended claims.

What is claimed is:

1. In a process for winding wire upon a reel and the like, the steps of winding a wire in conical layers upon a conical core of a reel until a predetermined outer diameter of a wound package is reached, and subsequently winding the wire in layers of decreasing lengths to form a wound package having an outer cylindrical shape of the predetermined diameter.

2. In a process as claimed in claim 1 and the step of supplying the wire at a constant speed while it is wound upon the core.

3. In a process as claimed in claim 2 and the step of varying the quantity of wire supplied with respect to the speed at which the wire is applied to the surface of the package being wound to achieve constant supply speed of the wire.

4. In a process for subsequent treatment of wire wound as claimed in claim 1 wherein said reel has a flange on a larger diameter end of the core and the step of removing from the wound package the core together with the flange after completion of the winding of the reel to define a hollow interior of the wound package, and unwinding the wire from the hollow interior of the wound package.

5. In a process for subsequent treatment of wire wound as claimed in claim 1 wherein said reel has a flange on a larger diameter end of the core and the steps of removing the flange and axially displacing the core to define a space between the core and the innermost layer of wound wire, and unwinding the wire through said space and out of the package.

6. In a process as claimed in claim 1 and enclosing the wound package in a packaging material to form a package for shipping.

7. In a process as claimed in claim 6 wherein the packaging material comprises an outer container, and attaching the conical core to the outer container prior to the winding operation to define a flange.

8. In a process as claimed in claim 7 and pulling the packaging material of the outer container during the winding operation in a direction toward the attached core and container, and bending the packaging material around the wound package upon completion of the winding operation to enclose the wound package.

9. In a process as claimed in claim 1 wherein the winding includes traverse of the wire upon the core and the step of reversing the direction of traverse of the wire as each predetermined diameter is attained in winding layers of decreasing lengths.

10. In a process as claimed in claim 9 and sensing the maximum winding diameter to control the reversing of direction of traverse of the wire.

11. In a process for subsequent treatment of wire wound as claimed in claim 5 and the step of positioning an annular plate on the end of the wound package.

12. In a process for subsequent treatment of wire wound as claimed in claim 11 and the step of closing a radial slot in said annular plate such that the annular plate defines an annular surface over which the wire can be pulled from the wound package.

13. In a process for subsequent treatment of wire wound as claimed in claim 11 and forming the annular plate as a portion of a cardboard container enclosing the wound package.

14. In a process for subsequent treatment of wire wound as claimed 13 and disposing a wear-resistant ring on the inner diameter of the annular plate to define a surface over which wire can be pulled.

15. In a process as claimed in claim 1 and the step of shrink-fitting a synthetic material around the wound package to enclose the wound package.

16. In a process as claimed in claim 1 and the step of removing from the wound package the core after completion of the winding of the package to define a hollow conical interior within the wound package, enclosing the wound package in a casing, and inserting a conical casing element within the hollow conical interior against the innermost layer of the winding of the package.

17. In a process as claimed in claim 1 and enclosing the wound package with a casing of cardboard.

18. In a process as claimed in claim 17 and attaching the cardboard casing to a pallet.

* * * * *